United States Patent [19]

Dixon

[11] Patent Number: 4,943,455

[45] Date of Patent: Jul. 24, 1990

[54] ARTIFICIAL FLOWER CONSTRUCTION

[76] Inventor: Paula D. Dixon, 1139 4th Ave., Los Angeles, Calif. 90019

[21] Appl. No.: 315,479

[22] Filed: Feb. 27, 1989

[51] Int. Cl.[5] ..... A41G 1/00

[52] U.S. Cl. ..... 428/26; 156/61

[58] Field of Search ..... 428/24, 25, 26, 17; 156/61

[56] References Cited

U.S. PATENT DOCUMENTS

| | | | |
|---|---|---|---|
| 1,879,677 | 9/1932 | Gockel | 428/26 |
| 2,075,327 | 3/1937 | Abrams et al. | 428/24 X |
| 2,552,274 | 5/1951 | Gentile | 428/24 X |
| 3,822,171 | 7/1974 | Bouillot | 428/24 X |

*Primary Examiner*—Henry F. Epstein
*Attorney, Agent, or Firm*—Roger A. Marrs

[57] ABSTRACT

An artificial flower or other decorative or novelty construction is disclosed herein having a flexible semi-rigid support such as a wire provided with a bulbous form about a plurality of shaped components which are attached so as to define a predetermined composite shape. The components are composed of an elastic material having the characteristic of normally biasing edge marginal regions of each component inwardly adding to the desired shape. An an example of such material, rubber latex may be used, and in one version, each component is self-supporting about the form when attached by gluing, while in another version, each component is glued to a supporting wire bent to a given orientation.

1 Claim, 1 Drawing Sheet

ARTIFICIAL FLOWER CONSTRUCTION

BACKGROUND OF THE INVENTION

1. Field of the Invention

The present invention relates to the field of artificial flowers and other decorative items having their principal components composed of an elastic-like material, such as rubber latex, having internal structural characteristics and surface textures simulating the flower or decorative construction being simulated.

2. Brief Description of the Prior Art

In the past, it has been the conventional practice to construct and provide an artificial decorative item such as flowers by employing materials composed of silk, wire, adhesives and the like so that when properly cut and shaped, as well as joined together, these components provide an artificial decorative item. Problems and difficulties have been encountered with such conventional practices that stem largely from the fact that even after the artificial construction has been completed, surface textures of the components do not simulate the desired article being artificially duplicated. As an example, when silk or plastic is being employed as the material for duplicating leaves or petals in flower constructions, the surface texture is unreal and generally requires additional painstaking painting and other decorative steps to achieve a realistic appearance. Furthermore, silk is extremely light and requires substantial support in order that a desired shape of petal or leaf be maintained in order to effect realism.

Whenever plastic materials are used, it is necessary that costly molds and forms be provided in order that the plastic may assume various surface textures and the like simulating the leaf or petal being duplicated. This, of course, is expensive and time-consuming and does not lend itself to experimentation and artistic design.

Therefore, a long-standing need has existed to provide a simple and relatively inexpensive way to construct and manufacture artificial decorative items, such as flowers, which utilizes a unique construction material, such as rubber latex or the like, having internal characteristics lending itself for shaping and supporting a plurality of components which, when gathered together, provide a decorative display of desired shape and configuration. Because of the unique construction material, surface texture is improved as well as integral reinforcement of the components that adds to the realistic display of a real article being artificially produced.

SUMMARY OF THE INVENTION

Accordingly, the above problems and difficulties are obviated by the present invention which provides a novel artificial decorative construction comprising a flexible base about which a plurality of components are secured to form a desired shape. For example, a flower may be simulated or duplicated artificially by providing an elongated wire having a form glued to one end about which a plurality of precisely cut petal constructions are glued in a layered formation so as to simulate a flower. Each of the petal components is formed from a rubberized material or elastic construction so that the edge marginal regions of each of the components internally contracts so as to provide a wavy or terminating edge which is realistic of a leaf or a petal.

The form about which the petal components are layered is preferably of a bulbous shape and the petals are glued thereto for securement to the wire. A floral tape is wound about the external surface of the wire duplicating a stem of the flower, while leaves are taped to the floral tape about the wire in spaced-apart relationship with respect to the petal construction. The leaves may be supported on a wire so that the leaves laterally extend a substantial distance from the wire support, providing a lifelike visual duplication of an actual flower and leaf.

Therefore, it is among the primary objects of the present invention to provide an artificial decorative item which is composed of material, such as being of an elastic nature, so that when layered in a suitable arrangement about a form, a floral representation results simulating a real flower.

Still another object of the present invention is to provide a novel artificial flower construction which is economical, easy to manufacture and which may be rapidly assembled into a unit simulating an actual flower including petals and leaves.

Another object of the present invention is to provide a novel artificial flower construction utilizing elastic materials such as those prevalent in the manufacturing of balloons so that the material may retain its color and surface texture in a way simulating an actual leaf or petal growth.

BRIEF DESCRIPTION OF THE DRAWINGS

The features of the present invention which are believed to be novel are set forth with particularity in the appended claims. The present invention, both as to its organization and manner cf operation, together with further objects and advantages thereof, may best be understood with reference to the following description, taken in connection with the accompanying drawings in which:

DESCRIPTION OF THE PREFERRED EMBODIMENT

Figure 1:
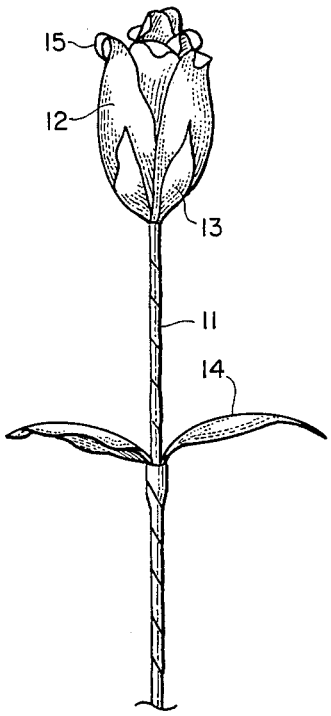
FIG. 1 is a front perspective view showing a completed artificial flower construction incorporating the present invention.
Figure 2A:
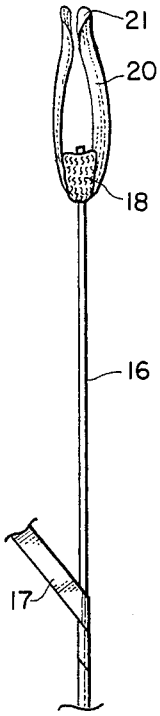
FIGS. 2*a, b* and *c* illustrate a construction sequence for producing the artificial flower construction shown in FIG. 1.
Figure 2B:
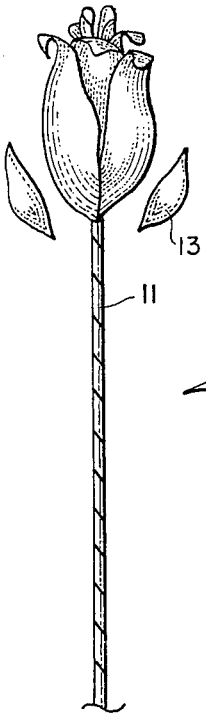
Figure 2C:
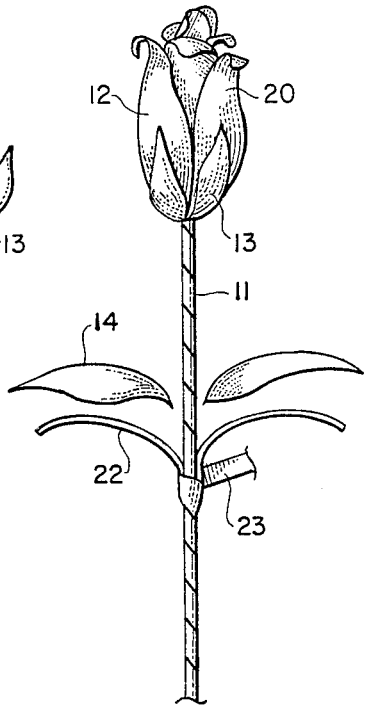

Referring to FIG. 1, a completed artificial flower 10 is illustrated demonstrating one embodiment or version of the present invention utilizing rubber latex material as components for the article The completed flower includes an elongated stem 11 terminating at one end in a flower bud having several leaves forming a calyx, indicated by numeral 13. The bud of the flower includes a plurality of individual components which are composed of the elastic material. Also, leaves represented by numeral 14 are similarly composed of elastic material, such as rubber latex. The surface texture of both the petals 12 and leaves 13 and 14 is smooth and not ribbed or irregular as is the case when silk flowers are used or when molded lines are placed into plastic components Also, it is to be noted with respect to the petals of the flower that the edge marginal regions, as indicated by numeral 15, are folded over due to internal material tension consistent with the use of elastic or rubberized material These edge curls are natural to the material and particularly in combination with the force of gravity when the edge is placed upwardly with respect to its support at the calyx.

Referring to FIG. *2a*, the formation of the artificial flower is achieved by initially utilizing a flexible or semirigid wire or strand 16 about which a floral tape 17 is wound in order to cover the exterior surface of the wire in a natural colored tape, such as green, for example. The extreme end of wire 16 is provided with a base or form 18 that is glued to the end of the wire. One example of the form is a cotton ball which is bulbous-shaped. Next, a plurality of precut petals serving as components for the flower 12 are attached at one end to the form 18, such as by gluing or other adhesive methods. A typical petal component is indicated by numeral 20 wherein one end is secured to the form 18 while the body of the petal extends upwardly, terminating in a free end that slightly curls due to the internal tension of the elastic material. The curl related to petal 20 is indicated by numeral 21. Next, a second petal is placed on the opposite side of form 18 and secured as previously described.

As illustrated in FIG. *2b*, additional petals are placed in layered fashion one upon the other in a circular manner about the form 18 and the underlying petals in the formation. Also, some petal components are longer than others so that an irregular flower top is produced. Next, the calyx is formed by adding at least four rubberized components about the bottom of the flower joining with the stem 11.

Referring now in detail to FIG. *2c*, additional leaves are provided along the length of the stem 11 by attaching one end of a wire, such as wire 22, to the external surface of the wrapped stem 11. Additional floral tape 23 is wound about the stem to secure the end of the wire thereto. Next, a leaf 14 is placed on top of the wire 22 and secured therewith by means of glue or other adhesive so that the leaf component is supported on the wire. It is to be understood that although a wire is used for supporting the rubberized material of the leaf component 14, no wire is used to support the individual leaf component comprising the flower or bud 12. The respective layered petals of the flower or bud are secured only at their extreme lower ends so that they are cantilevered upwardly and outwardly without additional support.

In one method of production, the individual flower petal components and leaf components are made from balloon material which is initially colored and having the degree of elasticity desired for the end representation. The shape of the respective components can be derived from a dye or punch tool or can be individually cut out. The cured rubber latex material, whether it's a balloon or sheet material, is cut into various shapes and sizes for the petals and leaves The petals are glued together, as shown in FIG. *2b*,or on top of the form 18 in layers of individual pieces in a concentric pattern. Preferably, the material cut to form leaves comprising the calyx is in an oval shape.

Figure 3:
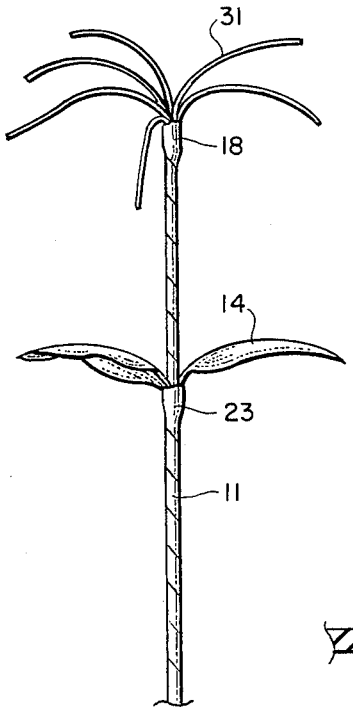
FIG. 3 is a front perspective view of another version of flower construction using the teachings of the present invention preparatory for addition of petals.

Referring now in detail to FIGS. 3 and *3a*, another version of the invention is illustrated in the general direction of arrow 30 wherein the stem 11 and the leaves 14 are constructed and fabricated in the manner described above. However, the flower is formed by providing a plurality of wires, such as wire 31. The plurality of wires are arranged in a radial fashion where one end of the wire terminates in the form 18 which is subsequently wrapped by the end of the floral tape 17 wound about the stem 11. In this manner, the plurality of wires outwardly project and are shaped so as to form a slight bend constituting a radiating pattern Next, a plurality of cured rubber latex leaves, such as leaf 32, is glued onto the respective wires to complete the formation of the flower. Once attachment of the respective petals has been placed on the wires, the appearance of the flower may be complete by adding paint either by direct brush or by spray so that various of color and ornamentation are achieved.

Figure 4:
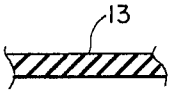
FIG. 4 is an enlarged fragmentary sectional view of a typical rubber-like flower component.
Figure 3A:
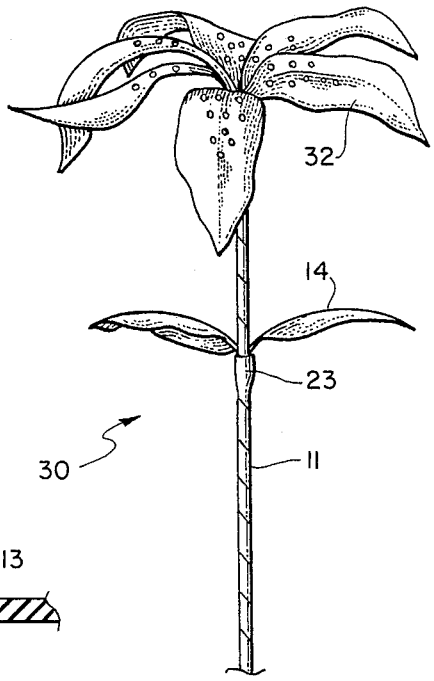
FIG. 3*a* illustrates the completed flower as shown in FIG. 3 with petals attached.

FIG. 4 is an extremely large fragmentary cross-sectional view of a petal or leaf component used in the present invention and is illustrated to show that the component material is of an elastic or rubberized composition.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An artificial flower construction comprising:

an elongated, flexible semi-rigid support having opposite ends;

a bulbous form of teardrop-shape secured to one end of said support;

a plurality of shaped components attached to said bulbous form in a cluster outwardly extending from said one end of said support in substantially coaxial relationship therewith and with each other;

said components composed of an elastic material characterized as having normally constricting bias along edge marginal regions thereof cooperating to shape each component in a predetermined configuration;

said component composition is cured rubber latex;

a strip of material carried about said support along its length in a wound and wrapped mounting between said opposite ends;

decorative elements adhesively attached in a predetermined pattern on the exterior exposed surface of each of said components; and each of said components is a representation of a portion of a flower bloom and collectively representing a full and complete flower bloom.

* * * * *